US012426759B2

(12) United States Patent
Li

(10) Patent No.: US 12,426,759 B2
(45) Date of Patent: Sep. 30, 2025

(54) ROLLER BRUSH ASSEMBLY AND MOVABLE DEVICE

(71) Applicant: SUZHOU ECOVACS SOFTWARE TECHNOLOGY CO., LTD., Suzhou (CN)

(72) Inventor: Qi Li, Shenzhen (CN)

(73) Assignee: SUZHOU ECOVACS SOFTWARE TECHNOLOGY CO., LTD., Suzhou (CN)

( * ) Notice: Subject to any disclaimer, the term of this patent is extended or adjusted under 35 U.S.C. 154(b) by 407 days.

(21) Appl. No.: 17/772,426

(22) PCT Filed: Nov. 16, 2020

(86) PCT No.: PCT/CN2020/129064
§ 371 (c)(1),
(2) Date: Apr. 27, 2022

(87) PCT Pub. No.: WO2021/109849
PCT Pub. Date: Jun. 10, 2021

(65) Prior Publication Data

US 2022/0378271 A1 Dec. 1, 2022

(30) Foreign Application Priority Data

Dec. 6, 2019 (CN) ..... 201911243438.1

(51) Int. Cl.
*A47L 11/40* (2006.01)
*A47L 11/24* (2006.01)

(52) U.S. Cl.
CPC ..... *A47L 11/4041* (2013.01); *A47L 11/24* (2013.01); *A47L 11/4069* (2013.01)

(58) Field of Classification Search
CPC ... A47L 11/4041; A47L 11/24; A47L 11/4069
See application file for complete search history.

(56) References Cited

U.S. PATENT DOCUMENTS 5,560,715 A * 10/1996 Mosby ..... F16C 33/805 384/488
9,456,723 B2 10/2016 Thorne et al.
(Continued)

FOREIGN PATENT DOCUMENTS

CN 101884509 B 12/2011
CN 102805596 A 12/2012
(Continued)

OTHER PUBLICATIONS

CN Notice of acceptance of request for invalidation dated Jan. 10, 2022 as received in Application No. 201922171689.5.
(Continued)

*Primary Examiner* — Shay Karls
(74) *Attorney, Agent, or Firm* — Maschoff Brennan

(57) ABSTRACT

A roller brush assembly and a movable device, and the roller brush assembly includes a roller brush, a power transmission apparatus disposed at one end of the roller brush. The power transmission apparatus includes a housing, a bearing, a power output wheel and a rotating shaft, where the power output wheel is fixedly connected with the rotating shaft, the bearing is fixedly mounted on the housing, and the rotating shaft passes through an inner bore of the bearing to drive the rotation of the roller brush. The movable device may effectively prevent threadlike objects such as, hairs and strings from entering the power transmission apparatus, resulting in the rotation failure of the roller brush.

17 Claims, 7 Drawing Sheets

(56) References Cited

U.S. PATENT DOCUMENTS

| | | | | |
|---|---|---|---|---|
| 2005/0138765 | A1 | 6/2005 | Lee | |
| 2014/0359968 | A1* | 12/2014 | Eriksson | A47L 9/0477 15/390 |
| 2016/0220080 | A1 | 8/2016 | Thorne | |

FOREIGN PATENT DOCUMENTS

| | | | |
|---|---|---|---|
| CN | 204049519 | U | 12/2014 |
| CN | 204765421 | U | 11/2015 |
| CN | 105361809 | A | 3/2016 |
| CN | 205234411 | U | 5/2016 |
| CN | 206285062 | U | 6/2017 |
| CN | 108194514 | A | 6/2018 |
| CN | 207429052 | U | 6/2018 |
| CN | 208319146 | U | 1/2019 |
| CN | 109549571 | A | 4/2019 |
| CN | 209122073 | U | 7/2019 |
| CN | 209611019 | U | 11/2019 |
| CN | 110840340 | A | 2/2020 |
| CN | 211796225 | U | 10/2020 |

OTHER PUBLICATIONS

CN Notice of transfer of documents dated Mar. 3, 2022 as received in Application No. 201922171689.5.
CN Decision on examination of request for invalidation dated Jun. 22, 2022 as received in Application No. 201922171689.5.
CN Office Action dated Nov. 6, 2024 as received in Application No. 201911243438.1.
CN Office Action dated Mar. 18, 2025 as received in Application No. 201911243438.1.

* cited by examiner

ROLLER BRUSH ASSEMBLY AND MOVABLE DEVICE

FIELD

The present disclosure relates to the field of home cleaning, and in particular to a roller brush assembly and a movable device.

BACKGROUND

Movable device such as, surface robot cleaners and handheld cleaners have been widely used in the field of home cleaning. For example, a surface robot cleaner generally includes a main body and a roller brush disposed on the main body; the roller brush is used for contacting a surface to be cleaned such that the stains, dust or impurities on the surface to be cleaned are raised and absorbed into the main body, thus achieving the purpose of cleaning.

In family life, flexible threadlike objects such as, hairs and strings are often wound around the roller brush with the rotation of the roller brush on the movable device; and the roller brush is driven by a motor and other driving device; and a power transmission apparatus is usually further disposed between the driving device and the roller brush to transfer power; power is transported in the power transmission apparatus through one or more transmission gears; and output gears in the transmission gears are connected with the roller brush through a power output shaft, thereby driving the rotation of the roller brush.

A power output wheel in the power transmission apparatus is buckled onto a housing of the power transmission apparatus. Therefore, flexible threadlike objects such as, hairs and strings will get into the power transmission apparatus through the clearance between the power output wheel and the housing, thus winding around the transmission gears of the power transmission apparatus, which will thus easily cause the jamming of the transmission gears and the rotation failure of the roller brush.

SUMMARY

In view of the above problem, a roller brush assembly and movable device are provided herein to solve the above problem or at least partially solve the above problem.

Based on one aspect of the embodiments herein, provided is a roller brush assembly, including:

a roller brush;

a power transmission apparatus, disposed at one end of the roller brush, where the power transmission apparatus includes a housing, a bearing, a power output wheel and a rotating shaft;

where the power output wheel is fixedly connected with the rotating shaft, and the bearing is fixedly mounted on the housing, and the rotating shaft passes through an inner bore of the bearing to drive the rotation of the roller brush.

Further, the bearing includes a rotating ring and a fixed ring, and a rolling body disposed between the rotating ring and the fixed ring, where a blocking portion is further provided between the rotating ring and the fixed ring; when the power output wheel drives the rotating shaft to rotate, the rotating ring rotates relative to the fixed ring, and the bearing blocks the entry of the flexible threadlike objects into the housing through the blocking portion.

Further, the power output wheel is abutted against the rotating ring of the bearing.

Further, the blocking portion is clamped between the rotating ring and the fixed ring; the rotating ring, the fixed ring and the blocking portion enclose an inner cavity for holding the rolling body.

Further, the power transmission apparatus further includes: a power input wheel; the power input wheel is synchronously driven with the power output wheel, and the power input wheel rotates to drive the rotation of the power output wheel and the rotating shaft, thus driving the roller brush to rotate.

Further, the bearing is located between the rotating shaft and the housing.

Further, the blocking portion is fixedly connected or integrally formed with the fixed ring, and the blocking portion is in a clearance fit with the rotating ring.

Further, a lubricating oil layer is provided in the inner cavity to block the entry of the flexible threadlike objects into the housing.

Further, the rotating ring is in an interference fit with the rotating shaft.

Further, the housing has a first receiving groove for holding the bearing on the inner side wall; and the first receiving groove is in fixed engagement with the fixed ring of the bearing.

Further, the first receiving groove is located in the power output wheel.

Further, the bearing is a ball bearing; the rotating ring is an inner ring, the fixed ring is an outer ring, and the rolling body is a roll ball.

Further, the blocking portion is circular and sheetlike, and axis where the center of the blocking portion is located is overlapped with the axis of the power output shaft;

and one end of the blocking portion is in a clearance fit with the rotating ring, and another end of the blocking portion is fixedly connected or integrally formed with the fixed ring.

Further, the roller brush assembly further includes a roller brush bracket, where one end of the roller brush bracket is connected with the rotating shaft, and another end of the roller brush bracket is connected with the roller brush.

Further, a drive sleeve is provided between the roller brush bracket and the rotating shaft; the drive sleeve is connected with the rotating shaft, and the roller brush bracket is connected with the rotating shaft through the drive sleeve.

Further, there is a preset clearance between the roller brush bracket/the drive sleeve and the housing.

Further, the roller brush bracket has a second receiving groove for holding the drive sleeve, and the drive sleeve is received in the second receiving groove, and the drive sleeve is detachably connected with the roller brush bracket.

Further, the drive sleeve is in an interference fit with the second receiving groove, and the amount of interference is less than a preset value such that the drive sleeve may is detachably connected with the roller brush bracket.

Further, a sectional dimension of the second receiving groove gradually increases from a direction close to the roller brush to a direction away from the roller brush.

Further, the housing includes an upper housing and a lower housing; the upper housing is detachably connected with the lower housing, and the first receiving groove is located at the lower housing.

Further, the roller brush assembly further includes a driving device for providing power; the driving device is connected with the power input wheel, and the power input wheel is located in the housing.

Further, the transmission mode between the power input wheel and the power output wheel is belt transmission or engagement transmission.

Further, a length direction of the driving device extends along a direction of the roller brush and parallel to an axis direction of the roller brush.

Based on a second aspect of the embodiments herein, provided is a roller brush assembly, including:

a roller brush, having a rotating shaft;

a power transmission apparatus, disposed at one end of the roller brush, where the power transmission apparatus includes a housing, a bearing, and a power output wheel;

where the power output wheel is fixedly connected with the rotating shaft, and the bearing is fixedly mounted on the housing, and the rotating shaft passes through an inner bore of the bearing to drive the rotation of the roller brush.

Based on a third aspect of the embodiments herein, provided is a movable device, including: a base plate, an upper cover, and any one of the roller brush assembly mentioned above; the base plate has a receiving cavity used for holding the roller brush assembly, and the roller brush assembly is detachably received in the receiving cavity.

Directed to the roller brush assembly and movable device provided by the embodiments herein, because the roller brush assembly includes a roller brush and a power transmission apparatus; and the power transmission apparatus includes a housing, a bearing, a power output wheel and a rotating shaft. Threadlike objects such as, hairs and strings on the roller brush are blocked from entering the power transmission apparatus through the bearing, which can effectively prevent the driving gear in the power transmission apparatus from being stuck by the winding of threadlike objects, thereby resulting in the rotation failure of the roller brush, and can effectively improve the safety and reliability of the roller brush assembly and the movable device.

BRIEF DESCRIPTION OF THE DRAWINGS

To explain the technical solutions of the embodiments of the present disclosure more clearly, the accompanying drawings required in the description of the embodiments will be introduced briefly. Apparently, the accompanying drawings described below are some embodiments of the present disclosure. Moreover, a person skilled in the art can further obtain other drawings according to these accompanying drawings without any inventive effort.

DETAILED DESCRIPTION OF EXAMPLE EMBODIMENTS

The technical solutions of the embodiments of the present disclosure will now be described more clearly hereinafter with reference to the accompanying drawings in the embodiments of the present disclosure. Apparently, the embodiments described are merely a portion of embodiments of the present disclosure, but not all the embodiments of the present disclosure. Based on the embodiments of the present disclosure, all the other embodiments obtained by a person skilled in the art without any inventive effort shall fall within the protection scope of the present disclosure.

Unless otherwise defined, all the technical and scientific terms used herein have the same meanings as commonly understood by a person skilled in the art to which this present disclosure belongs. Terms used in the description of the present disclosure herein are just for the purpose of describing particular embodiments, but not intended to be limiting of the present disclosure.

The "comprise" mentioned throughout the description and the claims is an open wording and thus, should be interpreted into "including, but not limited to". The "roughly" refers that a person skilled in the art can solve the technical problem within a certain error range, thus substantially achieving the technical effect within an acceptable error range.

Moreover, the word "connect" contains any direct and indirect means of connection herein. Therefore, if a first device is connected with a second device described herein, it represents that the first device may be directly connected with the second device, or indirectly connected with the second device through other device.

It should be understood that the term "and/or, and/or", used herein, is merely a correlation for describing associated objects, indicating that three relations may exist. For example, A1 and/or B1 may indicate the following three cases: existence of A1 alone, existence of A1 and B1 together, and existence of B1 alone. In addition, the character "/", used herein, generally indicates that there exists a relationship of "or" between the associated objects.

Some embodiments of the present disclosure will now be described in detail with reference to the accompanying drawings below. Different embodiments or examples and the features of the different embodiments or examples described in the description may be combined with each other by a person skilled in the art without mutual contradiction.

Figure 1:
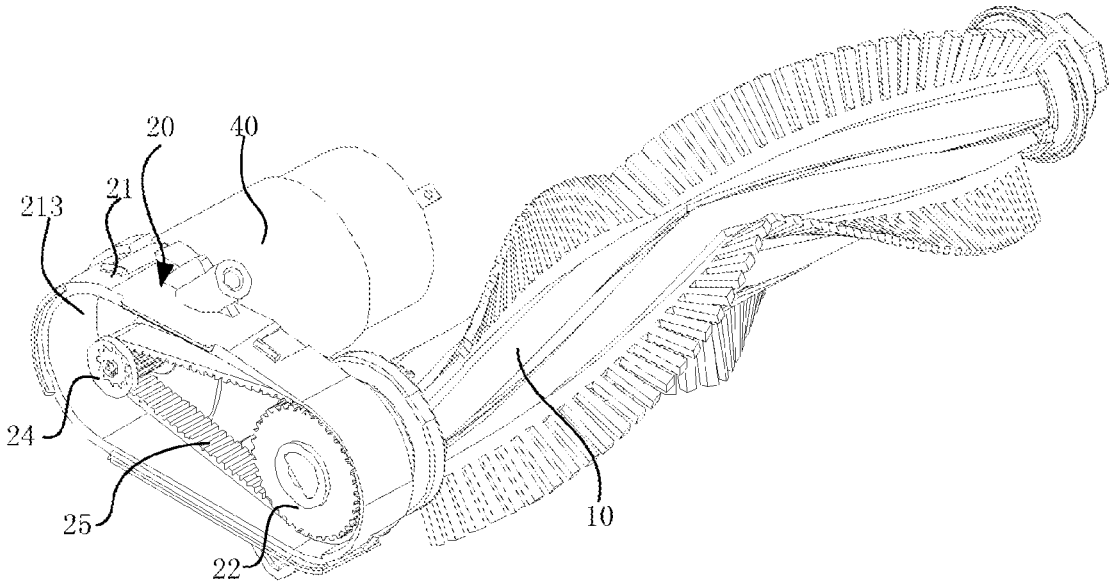
FIG. 1 is a structure diagram showing a roller brush assembly of a movable device provided by the embodiments of the present disclosure.
Figure 2:
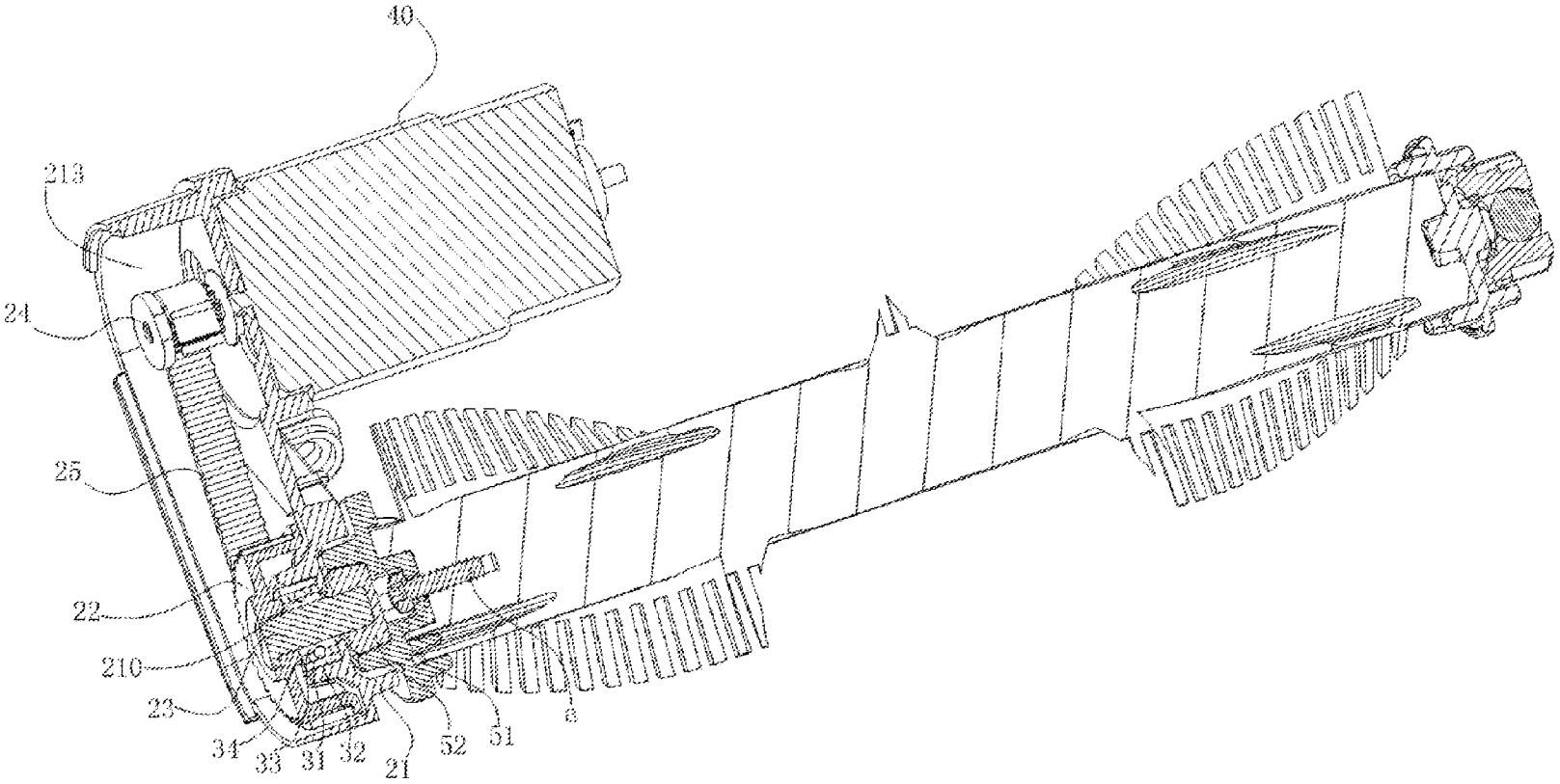
FIG. 2 is a partial sectional diagram showing the roller brush assembly of the movable device provided by the embodiments of the present disclosure.
Figure 3:
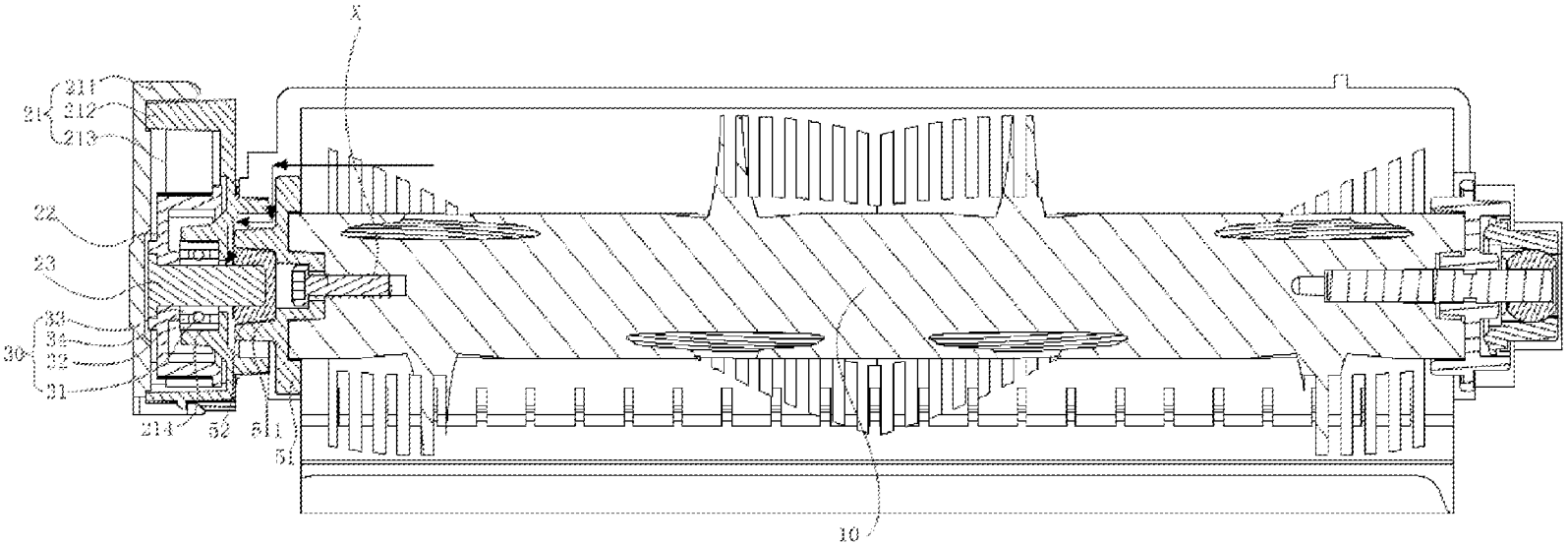
FIG. 3 is a side sectional diagram showing the roller brush assembly of the movable device provided by the embodiments of the present disclosure.

FIG. 1 is a structure diagram showing a roller brush assembly of a movable device provided by the embodiments of the present disclosure; FIG. 2 is a partial sectional diagram showing the roller brush assembly of the movable device provided by the embodiments of the present disclosure; FIG. 3 is a side sectional diagram showing the roller brush assembly of the movable device provided by the embodiments of the present disclosure. Referring to FIGS. 1 to 3, the roller brush assembly 100 provided by the present embodiment includes: a roller brush 10 and a power transmission apparatus 20.

The roller brush assembly 100 of the present embodiment may be mounted in a movable device, where the movable device may include a self-mobile robot cleaner, a manually mobile hand-held cleaner, and the like. The roller brush assembly 100 is mounted in a main body of the movable device; a roller brush 10 in the roller brush assembly 100 is driven by a power transmission apparatus 20 to rotate; and when the movable device moves forward for sweeping, the rotary roller brush 10 picks up garbage on the surface to be cleaned or wipes stains on the surface to be cleaned. Usually, in home cleaning, there exist flexible threadlike objects such as, hairs and strings wound around the roller brush 10. The present embodiment is aimed at the technical problem in the prior art, namely, when the roller brush assembly 100 is used for cleaning a surface to be cleaned, flexible threadlike objects such as, hairs and strings are wound around the roller brush 10 and then get into the power transmission apparatus 20 via the roller brush 10. Since the power transmission apparatus 20 at least includes a rotating shaft and a power output wheel connected with the rotating shaft, the flexible threadlike objects such as, hairs and strings are easily wound around the power output wheel to cause the jamming of the power output wheel, thus finally resulting in the rotation failure of the roller brush 10.

Specifically, the power transmission apparatus 20 in the present embodiment is disposed at one end of the roller brush 10, and the power transmission apparatus 20 includes a housing 21, a power output wheel 22, a rotating shaft 23, and a bearing 30.

The power output wheel 22 may be integrally formed or fixedly connected with the rotating shaft 23, and the bearing 30 is fixedly mounted on the housing 21, and the rotating shaft 23 passes through an inner bore of the bearing 30 to drive the rotation of the roller brush 10. The rotating shaft 23 of the power transmission apparatus 20 is connected with one end of the roller brush 10 while being mounted with the roller brush 10; and the power transmission 20 with the rotating shaft 23 is integrally disassembled from one end of the roller brush 10 when the roller brush 10 needs to be disassembled.

In other embodiments, the rotating shaft 23 may be a portion of the roller brush 10, i.e., the roller brush 10 has a rotating shaft 23, the rotating shaft 23 may be non-detachably connected with the roller brush 10, and the power transmission apparatus 20 has no rotating shaft. The rotating shaft 23 of the roller brush 10 is connected with the power output wheel 22 of the power transmission apparatus 20 while the power transmission apparatus 20 is mounted with the roller brush 10; and the roller brush 10 with the rotating shaft 23 is integrally disassembled from the power transmission apparatus 20 when the roller brush 10 needs to be disassembled.

The power output wheel 22 may be located in the housing 21. One end of the rotating shaft 23 may be fixedly connected with the power output wheel 22, and another end of the rotating shaft 23 may pass through the housing 21 and is fixedly connected with the roller brush 10 to drive the roller brush 10 to rotate; where the housing 21 may have a through hole 210 for the rotating shaft 23 to pass through; the diameter of the through hole 210 is slightly larger than the diameter of the rotating shaft 23 such that the rotating shaft 23 passes through and rotates in the through hole 210.

The housing 21 may include an upper housing 211 and a lower housing 212, and the upper housing 211 is detachably connected with the lower housing 212. Specifically, the detachable connection way may be as follows: the upper housing 211 may be detachably connected with the lower housing 212 by bolts and other fasteners, or detachably connected with each by a buckle. The upper housing 211 is buckled with the lower housing 212 to form a cavity 213, and the cavity 213 may be provided with a plurality of transmission wheels, where the plurality of transmission wheels may at least include a power output wheel 22 and a power input wheel 24; the power output wheel 22 may be fixedly connected with the rotating shaft 23, and the power input wheel 24 may be fixedly connected with a drive shaft of the driving device 40, where the driving device 40 may be a motor. The power input wheel 24 may be driven synchronously with the power output wheel 22 such that the power input wheel 24 rotates to drive the power output wheel 22 and the rotating shaft 23 to rotate, thus driving the rotation of the roller brush 10. In the present embodiment, preferably, a length direction of the driving device 40 may extend along a direction of the roller brush 10 and parallel to an axis direction of the roller brush 10. In this way, as shown in FIGS. 1 and 2, the driving device 40 may be disposed in parallel with the roller brush 10. The layout is reasonable and may save the mounting space of the roller brush assembly in the movable device as much as possible.

The transmission mode between the power input wheel 24 and the power output wheel 22 may be belt transmission or gear engaged transmission. In the present embodiment, the transmission mode between the power input wheel 24 and the power output wheel 22 is belt transmission. As shown in FIG. 1, a preset clearance is maintained between the power input wheel 24 and the power output wheel 22, and the power input wheel 24 is in transmission connection with and the power output wheel 22 by a belt 25. Compared with the mode of gear engagement transmission, the belt transmission has the advantages of smooth and steady transmission and low transmission noise.

In other embodiments, at least one intermediate wheel may also be provided between the power input wheel 24 and the power output wheel 22, and power may be transferred between the power input wheel 24 and the power output wheel 22 via the intermediate wheel. The transmission modes between the power input wheel 24 and the intermediate wheel, between the intermediate wheel and the intermediate wheel, and between the intermediate wheel and the power output wheel 22 may be belt transmission or gear engagement transmission. A person skilled in the art may make an option according to the specific requirements.

In the roller brush assembly provided by the embodiments herein, because the roller brush assembly includes a roller brush and a power transmission apparatus; and the power transmission apparatus includes a housing, a bearing, a power output wheel and a rotating shaft; the bearing is fixed on the housing, and the rotating shaft passes through the inner bore of the bearing to drive the rotation of the roller brush. Threadlike objects such as, hairs and strings on the roller brush may be effectively blocked from entering the power transmission apparatus through the bearing, which may effectively prevent the driving wheel in the power transmission apparatus from being stuck by the winding of threadlike objects, thereby resulting in the rotation failure of the roller brush, and effectively improve the safety and reliability of the roller brush assembly and the movable device. Based on the above embodiments, specifically, the bearing 30 may be located between the power output wheel 22 and the housing 21, and the bearing 30 may include a rolling body 31, a rotating ring 33 and a fixed ring 32 which are sleeved coaxially, and a blocking portion 34 disposed between the rotating ring 33 and the fixed ring 32; the rolling body 31 is disposed between the rotating ring 33 and the fixed ring 32 such that the rotating ring 33 may rotate relative to the fixed ring 32. The bearing 30 has an inner surface in contact with the power output shaft 22 and an outer surface in contact with an inner side wall of the housing 21. In the present embodiment, preferably, the bearing 30 is a ball bearing, the rotating ring 33 is an inner ring, the fixed ring 32 is an outer ring, and the rolling body 31 is a roll ball. A plurality of roll balls may be uniformly distributed between the rotating ring 33 and the fixed ring 32 in a circumferential direction around the axes of the inner ring and the outer ring. Alternatively, the bearing 30 is a roller bearing, the rolling ring 32 is an inner ring, the fixed ring 32 is an outer ring, and the rolling body 31 is a pin roller; a plurality of pin rollers may be uniformly distributed between the rotating ring 33 and the fixed ring 32 in a circumferential direction around the axes of the inner ring and the outer ring. Compared with the roller bearing, the ball bearing has a way of point contact with the inner ring and the outer ring, while the roller bearing has a way of line contact with the inner ring and the outer ring. The ball bearing has lower friction resistance, lower power consumption and higher mechanical efficiency. The rotating ring 33 is sleeved on the rotating shaft 23 and fixedly connected with the rotating shaft 23; the fixed ring 32 is fixedly connected with the housing 21, and when the rotating ring 33 rotates relative to the fixed ring 32, a blocking portion 34 for blocking flexible threadlike objects from entering therebetween is provided between the rotating ring 33 and the fixed ring 32. Specifically, as shown in FIG. 2, a feasible embodiment is as follows: one end of the blocking portion 34 is fixedly connected or integrally formed with the fixed ring 32, and another end of the blocking portion 34 is in a clearance fit with the rotating ring 33; the clearance between the blocking portion 34 and the rotating shaft of the rotating ring 33 is insufficient to allow the flexible threadlike objects to enter the housing.

The fixed ring 32, the rotating ring 33 and the blocking portion 34 may together enclose an inner cavity for holding the rolling body 31, and the inner cavity may have a lubricating oil layer to further block the entry of the flexible threadlike objects into the housing 21 by the lubricating oil layer. The so-called lubricant oil layer is formed by filling lubricating oil into the inner cavity of the bearing.

Moreover, for another example, the fixed ring 32 includes a first extension portion; the first extension portion may be formed on the condition that the fixed ring 32 extends inward radially to be in contact with an outer edge of the rotating ring 32; the first extension portion forms a blocking portion 34; the blocking portion 34 is integrally formed or fixedly connected with the fixed ring 32, and the blocking portion 34 is in a clearance fit with the rotating ring 33; the clearance between the blocking portion 34 and the rotating ring 33 is insufficient to allow the flexible threadlike objects to enter the housing; and the inner cavity of the bearing may also have a lubricating oil layer, and the lubricating oil layer may also block the entry of the flexible threadlike objects, thereby preventing the entry of the flexible threadlike objects into the housing. The shape of the blocking portion 34 may be circular and sheetlike, and axis where the center of the blocking portion 34 is located is overlapped with the axis of the rotating shaft; and the blocking portion 34 is embedded between the rotating ring 33 and the fixed ring 32 without increasing the axial thickness of the bearing 30.

Moreover, the power output wheel 22 may be abutted against the rotating ring 33 of the bearing 30 in the axial direction. Because the bearing 30 is fixedly connected with the housing 21, the power output wheel 22 is further abutted against the rotating ring 33 of the bearing 30, and the power output wheel 22 is further fixed to the rotating shaft 23, such that the positions of the rotating shaft 23 and the bearing 30 may be kept same in the axial direction. The power output wheel 22, the rotating ring 33 of the bearing 30 and the rotating shaft 23 rotate together without any abrasion therebetween.

The blocking portion 34 is clamped between the rotating ring 33 and the fixed ring 32; the rotating ring 33, the fixed ring and the blocking portion 34 enclose an inner cavity for holding the rolling body 31. In this way, the blocking portion 34 is located between the rotating ring 33 and the fixed ring 32 free of being in contact with the rotating shaft 23. Therefore, the rotation of the rotating shaft 23 will not cause abrasion of the blocking portion 34.

It should be indicated that the word "clamped" herein merely shows a relative position relation among the blocking portion 34, the rotating ring 33 and the fixed ring 32, but will not mean that the rotating ring 33 and the fixed ring 32 apply a clamping force or an abutting force on the blocking portion 34.

Based on the roller brush assembly provided in the present embodiment, the bearing 30 further includes a rotating ring 33, a fixed ring 32, a rolling body 31 and a blocking portion 34; where one end of the blocking portion 34 is fixedly connected or integrally formed with the fixed ring 32, and another end of the blocking portion 34 is in a clearance fit with the rotating ring 33, and the rotating ring 33 is fixedly connected with the rotating shaft, the fixed ring 32 is fixedly connected with the housing; the rolling body 31 is disposed between the rotating ring 33 and the fixed ring 32 such that the rotating ring 33 may rotate relative to the fixed ring 32; the rotating shaft passes through the housing and is connected with the roller brush; the rotating shaft rotates to drive the rotation of the rotating ring 33 and the roller brush, while the fixed ring and the housing are kept still. Threadlike objects such as, hairs and strings cannot enter the housing; the blocking portion 34 is in a clearance fit with the rotating ring 33. The blocking portion blocks the entry of the threadlike objects such as, hairs and strings on the roller brush into the power transmission apparatus, which may effectively prevent the driving wheel in the power transmission apparatus from being stuck by the winding of threadlike objects, thereby resulting in the rotation failure of the roller brush, and effectively improve the safety and reliability of the roller brush assembly.

In the above embodiment, the rotating ring 33 may be in an interference fit with the rotating shaft 23. The rotating ring 33 is in an interference fit with the rotating shaft 23 to achieve balanced stress in the circumferential direction of the rotating ring 33, which may ensure that the rotating ring 33 is concentric with the rotating shaft 23. After being coupled, the two elements have good reliability, are not prone to movement and may reliably transfer torque. Definitely, the fixed connection mode between the rotating ring 33 and the rotating shaft 23 may also include fastener connection, bonding, buckling and the like. The fixed connection mode is not particularly defined herein as long as the rotating shaft 23 can rotate to drive the synchronous rotation of the rotating ring 33 without relative rotation therebetween.

As shown in FIGS. 2 and 3, further, the inner side wall of the housing 21 may have a first receiving groove 214 for holding the bearing 30, and the first receiving groove 214 is in an interference fit with the fixed ring 32 of the bearing 30. Specifically, a cylindrical body protruding towards the cavity 213 may be formed on the inner side wall of the housing 21; the cylindrical body and the inner side wall of the housing 21 enclose the first receiving groove 214. The fixed ring 32 of the bearing 30 is in an interference fit with the first receiving groove 214, and the fixed ring 32 is stressed uniformly in the circumferential direction, which may ensure that the fixed ring 32 is firmly fixed on the housing 21.

In the present embodiment, the first receiving groove 214 may be located in the power output wheel 22, and the power output wheel 22 may be a hollow cylindrical structure to form an inner cavity on the power output wheel 22; and a portion of the housing 21 provided with the first receiving groove 214 may protrude into the inner cavity of the power output wheel 22 such that the first receiving groove 214 is located in the power output wheel 22, thereby making the overall structure more compact and reducing the overall thickness of the power transmission apparatus.

More specifically, the first receiving groove 214 may be located on the lower housing 212; an inner side wall of the lower housing 212 is provided with a protruding portion which protrudes toward the upper housing 211, and the first receiving groove 214 may be opened on the protruding portion.

The roller brush assembly provided in the present embodiment further includes a roller brush bracket 51; one end of the roller brush bracket 51 is connected with the rotating shaft 23, and another end of the roller brush bracket 51 is connected with the roller brush 10. Preferably, the roller brush bracket 51 may be detachably connected with the roller brush 10. As shown in FIG. 3, the roller brush bracket 51 may be screwed with the roller brush 10 by screws a, so as to facilitate the assembly of the roller brush bracket 51 and mounting of the roller brush; the screws a may be coaxial with the roller brush 10 such that the roller brush bracket 51 is subjected to a fastening force at the central axis, thus achieving balanced circumferential force of the roller brush bracket 51.

A drive sleeve 52 is provided between the roller brush bracket 51 and the rotating shaft 23; the roller brush bracket 51 is connected with the roller brush 10, the drive sleeve 52 is connected with the rotating shaft 23, and the roller brush bracket 51 is connected with the rotating shaft 23 via the drive sleeve 52. Similarly, the drive sleeve 52 may have a clamping slot for holding the end portion of the rotating shaft 23, and the rotating shaft 23 may be in an interference fit with the clamping slot. The roller brush bracket 51 has a second receiving groove 511 for holding the drive sleeve 52, and the drive sleeve 52 is received in the second receiving groove 511, and the drive sleeve 52 is detachably connected with the roller brush bracket 51. The drive sleeve 52 is detachably connected with the roller brush bracket 51 to facilitate the removal of the roller brush 10.

Preferably, the drive sleeve 52 may be in an interference fit with the second receiving groove 511, and the amount of interference is less than a preset value such that the drive sleeve 52 is detachably connected with the roller brush bracket 51. The drive sleeve 52 is in an interference fit with the second receiving groove 511, so as to ensure that the drive sleeve 52 may transfer the torque of the rotating shaft 23 to the roller brush bracket 51 and the roller brush 10. When the amount of interference is less than the preset value, the drive sleeve 52 can be separated from the roller brush bracket 51 when the external force is greater than the preset value, thus taking out the roller brush 10 from the movable device.

Further, as shown in FIG. 3, there is a preset clearance x provided between the roller brush bracket 51 and the housing 21, and between the drive sleeve 52 and the housing 21. Flexible threadlike objects such as, hairs and strings wound around the roller brush 10 may be allowed to flow into the preset clearance x through the rotation of the roller brush 10 (the direction shown by the arrows in FIG. 3 is the flow direction of the flexible threadlike objects), and be received in the preset clearance x. However, due to the blocking of the bearing 30, the flexible threadlike objects will not continue to flow into the power output wheel 22 of the power transmission apparatus 20 such that the power output wheel 22 is free of jamming. That is, the transmission of the whole power transmission apparatus 20 will be not affected, and the rotation of the roller brush 10 will be not affected, either.

Additionally, the flow path of the flexible threadlike objects guided by the preset clearance x may be curved such that the flow path of the flexible threadlike objects in the preset clearance x may be extended as much as possible within a limited space, thus obtaining a larger receiving space to hold more flexible threadlike objects.

When it is necessary to clean the flexible threadlike objects such as, hairs and strings in the preset clearance x, the drive sleeve 52 together with the power transmission apparatus 20 may be separated from the roller brush bracket 51 and the roller brush 10, and thus, the roller brush 10 is taken out and the drive sleeve 52 is removed by upwarping to expose the preset clearance x such that the operator can clean the flexible threadlike objects such as, hairs and strings in the preset clearance x.

Figure 6:
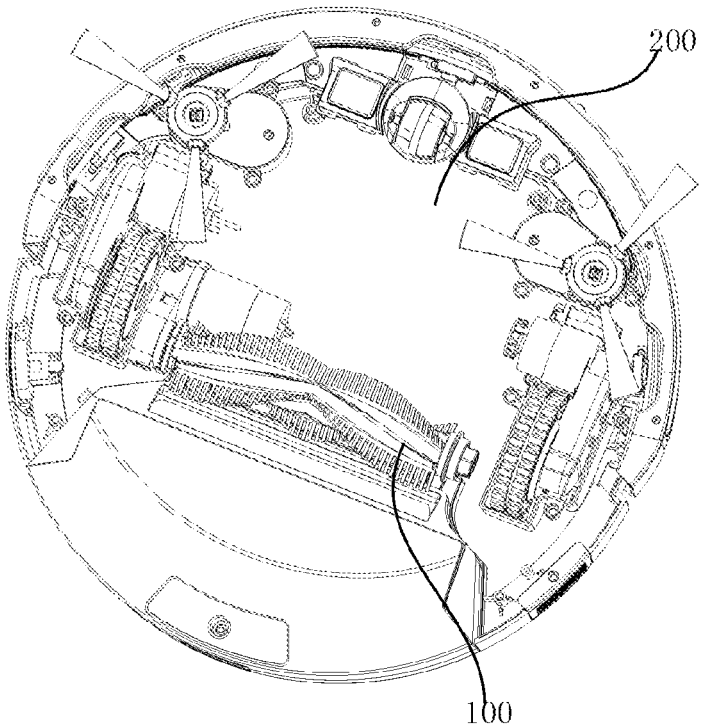
FIG. 6 is a schematic diagram I showing a state of the base plate of the movable device provided by the embodiments of the present disclosure in a process of taking out the roller brush.
Figure 7:
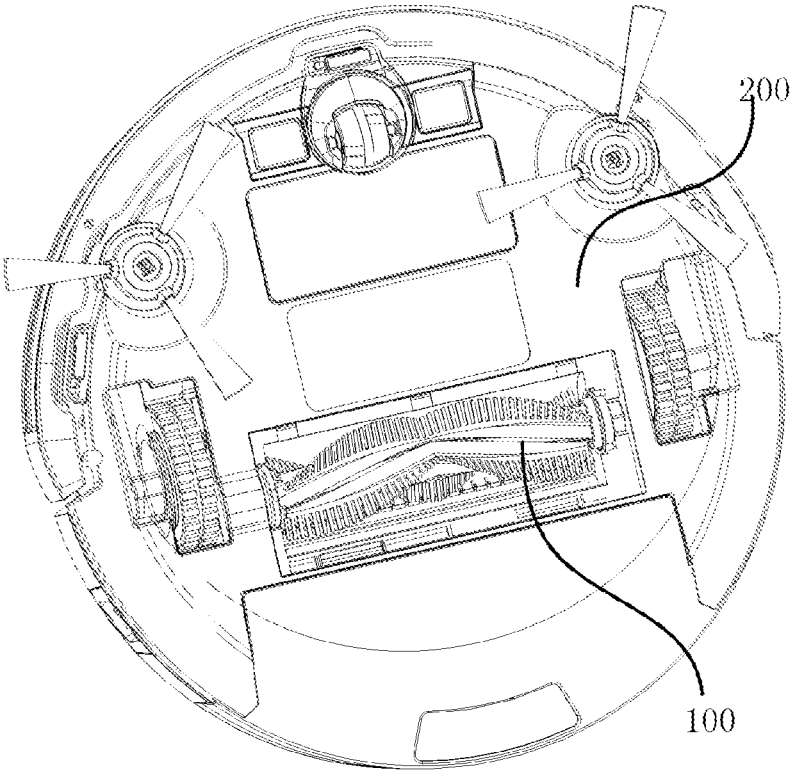
FIG. 7 is a schematic diagram II showing a state of the base plate of the movable device provided by the embodiments of the present disclosure in the process of taking out the roller brush.

As shown in FIG. 3, the sectional dimension of the second receiving groove 511 gradually increases from a direction close to the roller brush 10 to a direction away from the roller brush 10. FIG. 6 is a schematic diagram I showing a state of the base plate of the movable device provided by the embodiments of the present disclosure in the process of taking out the roller brush; FIG. 7 is a schematic diagram II showing a state of the base plate of the movable device provided by the embodiments of the present disclosure in the process of taking out the roller brush. FIG. 6 shows a state in which the right end of the roller brush is taken out of the receiving cavity 101, and FIG. 7 shows a state in which the left end of the roller brush is also taken out of the receiving cavity 101. The roller brush assembly 100 is mounted in the movable device. During the process of assembling the roller brush 10, the left end of the roller brush 10 is firstly mounted into the receiving cavity 101 used for holding the roller brush 10 in the movable device. In the mounting process, the sectional dimension of the second receiving groove 511 gradually increases from a direction close to the roller brush 10 to a direction away from the roller brush 10, such that the roller brush bracket 51 may be smoothly mounted to be matched with the drive sleeve 52. The right end of the roller brush 10 may be placed in the clamping slot at the right end of the receiving cavity 101. However, when the roller brush 10 is disassembled, as shown in FIG. 6, the right end of the roller brush 10 may be taken out firstly, and then the left end of the roller brush 10 is pulled out by a force towards the upper right direction (as shown in FIG. 7), thus taking out the roller brush 10; that is, the roller brush bracket 51 is separated from the drive sleeve 52. Since the sectional dimension of the second receiving groove 511 gradually increases from a direction close to the roller brush 10 to a direction away from the roller brush 10, it is more convenient to guide the roller brush bracket 51 to be separated from the drive sleeve 52. That is, the configuration facilitates that the left end of the roller brush 10 is separated from the receiving cavity 101.

Definitely, it should be indicated that the left and right ends of the roller brush 10 are merely examples. When the power transmission apparatus 20 is located at the right end of the roller brush 10, the left end of the roller brush 10 is first mounted into the receiving cavity 101 and then the right end of the roller brush 10 is connected with the power transmission apparatus 20 during the mounting process of the roller brush 10. Alternatively, in the process of taking out the roller brush 10, the left end of the roller brush 10 is taken out of the receiving cavity 101, and then the right end of the roller brush 10 is separated from the drive sleeve 52.

Figure 4:
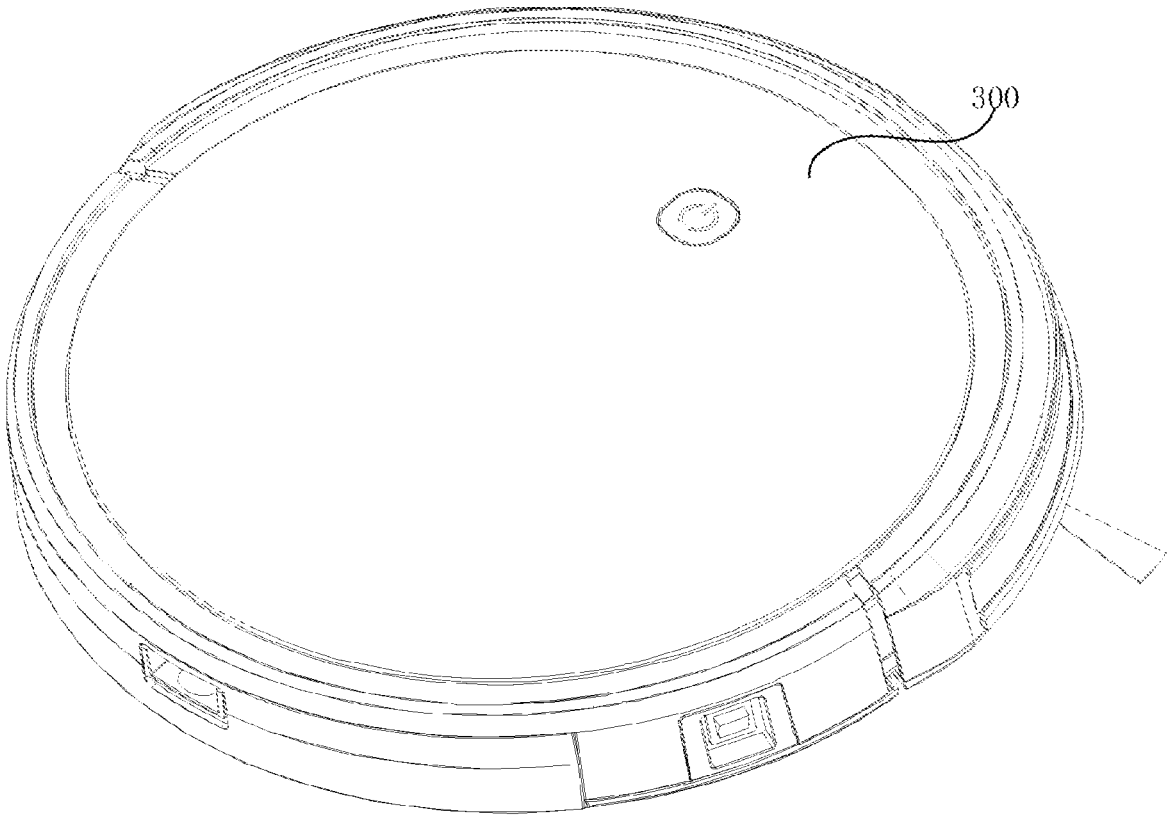
FIG. 4 is a structure diagram showing a movable device provided by the embodiments of the present disclosure.
Figure 5:
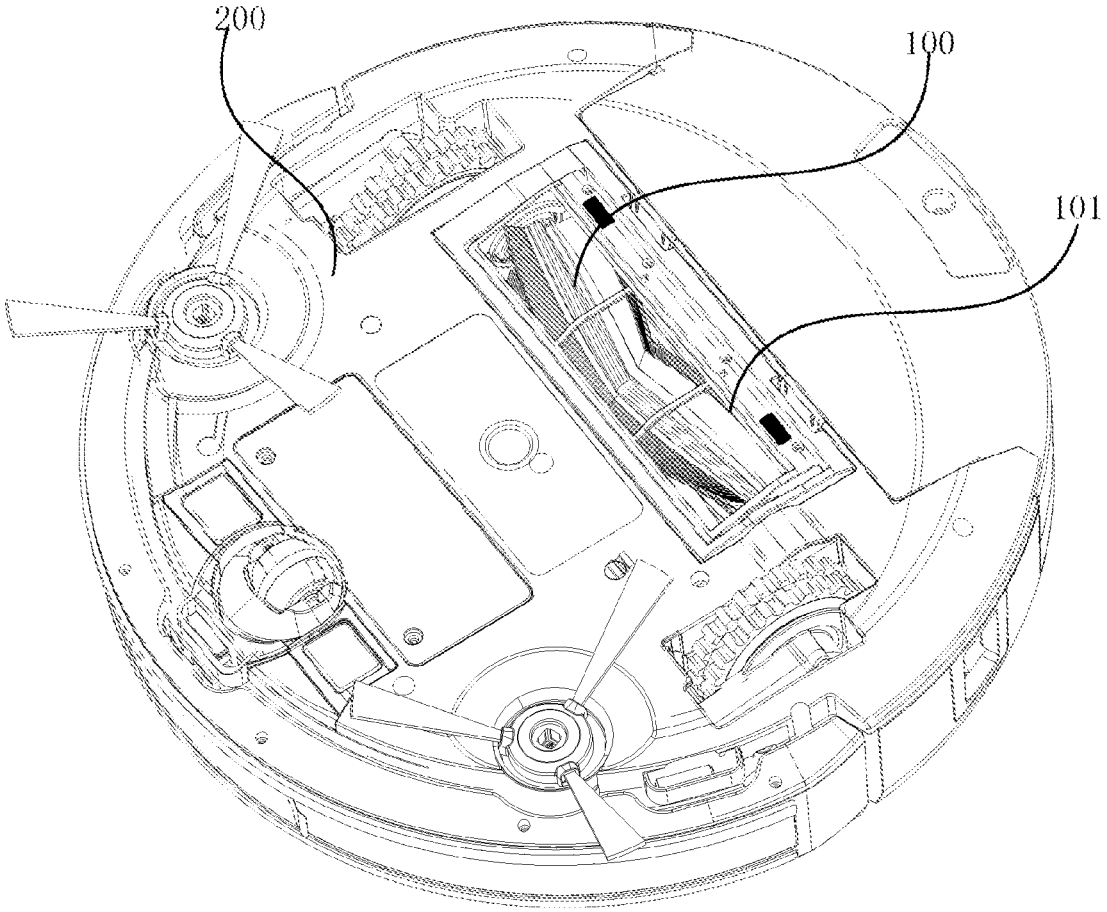
FIG. 5 is a structure diagram showing a base plate of the movable device provided by the embodiments of the present disclosure.

The present embodiment provides a movable device. FIG. 4 is a structure diagram showing a movable device provided by the embodiments of the present disclosure; and FIG. 5 is a structure diagram showing a base plate of the movable device provided by the embodiments of the present disclosure. As shown in FIGS. 4 and 5, the movable device includes: a base plate 200, an upper cover 300, and a roller brush assembly 100. The base plate 200 has a receiving cavity 101 for holding the roller brush assembly 100, and the roller brush assembly 100 is detachably received in the receiving cavity 101.

The roller brush assembly 100 includes: a roller brush 10; a power transmission apparatus 20 disposed at one end of the roller brush 10; the power transmission apparatus 20 includes a housing 21, a bearing 30, a power output wheel 22 and a rotating shaft 23; where the power output wheel 22 is fixedly connected with the rotating shaft 23, the bearing 30 is fixedly mounted on the housing 21, and the rotating shaft 23 passes through the inner hole of the bearing to drive the roller brush 10 to rotate.

Alternatively, in a further embodiment, the rotating shaft 23 may be a portion of the roller brush 10. That is, the roller brush 10 has a rotating shaft 23 thereon, and the movable device includes: a base plate 200, an upper cover 300, and a roller brush assembly 100, where the base plate 200 has an receiving cavity 101 for holding the roller brush assembly 100, and the roller brush assembly 100 is detachably received in the receiving cavity 101; where the roller brush assembly 100 includes: a roller brush 10 having a rotating shaft 23, a power transmission apparatus 20 disposed at one end of the roller brush 10; the power transmission apparatus 20 includes a housing 21, a bearing 30 and a power output wheel 22; where the power output wheel 22 is fixedly connected with the rotating shaft 23, the bearing 30 is fixedly mounted on the housing 21, and the rotating shaft 23 passes through the inner hole of the bearing 30 to drive the roller brush 10 to rotate.

The specific structure and function of the roller brush assembly 100 can be described with reference to above embodiment, but will not be described in detail here. The movable device of the present embodiment may be a self-mobile robot cleaner, a hand-held cleaner, and the like. In the present embodiment, the self-mobile robot cleaner is set as an example for description. Specifically, the self-mobile robot cleaner may further include a body, a dust suction mechanism (not shown in the drawings) and a driving device 40; the body includes a base plate 200 and an upper cover 300, where the upper cover 300 may be detachably disposed on the base plate 200, and the upper cover 300 may protect various functional components inside the self-mobile robot cleaner from being damaged by violent impacts or unintentionally dripping liquid during the use of the self-mobile robot cleaner; the base plate 200 may be used to bear and support the various functional components such as, for example, a dust collection mechanism. The dust suction mechanism is used for sucking garbage on a surface to be cleaned (e.g., ground), and the dust suction mechanism includes a roller brush 10; the roller brush 10 may be mounted in the base plate 200 in a transverse direction to pick up the garbage on the ground when the self-mobile robot cleaner moves forward for sweeping; where the transverse direction refers to a direction perpendicular to the advancing direction of the self-mobile robot cleaner. The roller brush 10 is received in the receiving cavity 101, and a roller brush cover (not shown in the drawings) is used to position the roller brush 10 in the receiving cavity 101.

The roller brush assembly and movable device provided by the embodiments of the present disclosure will be described below in combination with the specific application scenarios:

Application Scenario 1

When a user uses a self-mobile robot cleaner to clean the floor of a house, the self-mobile robot cleaner moves continuously and the roller brush rolls on the floor to suck impurities, dust, hairs, strings and other flexible threadlike objects on the floor into a dust suction mechanism. The flexible threadlike objects are more or less wound around the roller brush; the flexible threadlike objects are driven by the rotation of the roller brush into a preset clearance between a housing of a power transmission apparatus and a roller brush connection assembly, and are blocked by a bearing between the housing and a power output wheel. Therefore, the flexible threadlike objects will not enter the power output wheel and thus, not cause the jamming of the power output wheel, free of affecting the rotation of the roller brush.

Application Scenario 2

A user uses a hand-held cleaner. A roller brush assembly of the hand-held cleaner is mounted on a base plate of a floor brush; when the user drags the floor brush back and forth, the roller brush rolls on the floor to suck impurities, dust, hairs, strings and other flexible threadlike objects on the floor into a dust suction mechanism. The flexible threadlike objects are more or less wound around the roller brush; the flexible threadlike objects are driven by the rotation of the roller brush into a preset clearance between a housing of a power transmission apparatus and a roller brush connection assembly, and are blocked by a bearing between the housing and a power output wheel. Therefore, the flexible threadlike objects will not enter the power output wheel and thus, not resulting in the jamming of the power output wheel, free of affecting the rotation of the roller brush.

In the several embodiments provided by the present disclosure, the mutual coupling or direct coupling or communication connection shown or discussed may be indirect coupling or communication connection via some interfaces, device or units, and may be electrical, mechanical, or other forms.

Finally, it should be indicated that: the above embodiments are merely illustrative of the technical solutions of the present disclosure, but not construed as limiting the same. Although the present disclosure has been described in detail with reference to the foregoing embodiments, it should be appreciated that a person skilled in the art can still modify the technical solutions disclosed in the foregoing embodiments, or make equivalent replacements on a portion of or all the technical features thereof. Moreover, these modifications or replacements will not render the essence of the corresponding technical solution to depart from the scope of the technical solution in the embodiments of the present disclosure.

What is claimed is:

1. A roller brush assembly, comprising:

a roller brush;

a power transmission apparatus, disposed at one end of the roller brush, wherein the power transmission apparatus comprises a housing, a bearing, a power output wheel and a rotating shaft;

wherein the housing comprises a lower housing;

wherein the power output wheel is fixedly connected with the rotating shaft, the bearing is fixedly mounted on the lower housing, and the rotating shaft passes through an inner bore of the bearing to drive the rotation of the roller brush;

wherein the lower housing is provided between the bearing and the roller brush.

2. The roller brush assembly according to claim 1, wherein the bearing comprises a rotating ring, a fixed ring, and a rolling body disposed between the rotating ring and the fixed ring; a blocking portion is further provided between the rotating ring and the fixed ring; and one end of the blocking portion is in a clearance fit with the rotating ring; when the power output wheel drives the rotating shaft to rotate, the rotating ring rotates relative to the fixed ring, and the bearing blocks a flexible threadlike object from entering the housing through the blocking portion.

3. The roller brush assembly according to claim 1, wherein the power output wheel is abutted against the rotating ring of the bearing.

4. The roller brush assembly according to claim 3, wherein the blocking portion is clamped between the rotating ring and the fixed ring, and the rotating ring, the fixed ring and the blocking portion enclose an inner cavity for holding the rolling body.

5. The roller brush assembly according to claim 4, wherein the inner cavity has a lubricating oil layer to block the flexible threadlike object from entering the housing.

6. The roller brush assembly according to claim 1, wherein the power transmission apparatus further comprises a power input wheel; the power input wheel is synchronously driven with the power output wheel, and the power input wheel rotates to drive the rotation of the power output wheel and the rotating shaft, thus driving the roller brush to rotate.

7. The roller brush assembly according to claim 6, further comprising:

a driving device for providing power; wherein the driving device is connected with the power input wheel, and the power input wheel is located in the housing.

8. The roller brush assembly according to claim 1, wherein the bearing is located between the rotating shaft and the housing.

9. The roller brush assembly according to claim 1, wherein the blocking portion is fixedly connected or integrally formed with the fixed ring, and the blocking portion is in a clearance fit with the rotating ring.

10. The roller brush assembly according to claim 1, wherein a first receiving groove for holding the bearing is provided on an inner side wall of the housing; and the first receiving groove is in fixed engagement with the fixed ring of the bearing.

11. The roller brush assembly according to claim 10, wherein the first receiving groove is located in the power output wheel.

12. The roller brush assembly according to claim 10, wherein the housing comprises an upper housing and a lower housing; the upper housing is detachably connected with the lower housing, and the first receiving groove is located at the lower housing.

13. The roller brush assembly according to claim 1, wherein the bearing is a ball bearing; the rotating ring is an inner ring, the fixed ring is an outer ring, and the rolling body is a roll ball.

14. The roller brush assembly according to claim 1, wherein the blocking portion is circular and sheetlike, and an axis where the center of the blocking portion is located is overlapped with an axis of the power output shaft; and another end of the blocking portion is fixedly connected or integrally formed with the fixed ring.

15. The roller brush assembly according to claim 1, further comprising:

a roller brush bracket, wherein one end of the roller brush bracket is connected with the rotating shaft, and another end of the roller brush bracket is connected with the roller brush.

16. A roller brush assembly, comprising:

a roller brush, having a rotating shaft;

a power transmission apparatus, disposed at one end of the roller brush, wherein the power transmission apparatus comprises a housing, a bearing, and a power output wheel; wherein the housing comprises a lower housing;

wherein the power output wheel is fixedly connected with the rotating shaft, and the bearing is fixedly mounted on the lower housing, and the rotating shaft passes through an inner bore of the bearing to drive the rotation of the roller brush;

wherein the lower housing is provided between the bearing and the roller brush.

17. A movable device, comprising: a base plate, an upper cover, and a roller brush assembly, wherein the base plate has a receiving cavity used for holding the roller brush assembly, and the roller brush assembly is detachably received in the receiving cavity; wherein the roller brush assembly comprises:

a roller brush;

a power transmission apparatus, disposed at one end of the roller brush, wherein the power transmission apparatus comprises a housing, a bearing, a power output wheel and a rotating shaft;

wherein the housing comprises a lower housing;

wherein the power output wheel is fixedly connected with the rotating shaft, and the bearing is fixedly mounted on the lower housing, and the rotating shaft passes through an inner bore of the bearing to drive the rotation of the roller brush;

wherein the lower housing is provided between the bearing and the roller brush.

* * * * *